US009558901B2

(12) United States Patent
Kato

(10) Patent No.: US 9,558,901 B2
(45) Date of Patent: Jan. 31, 2017

(54) METHOD OF MANUFACTURING BUS BAR

(71) Applicant: YAZAKI CORPORATION, Minato-ku, Tokyo (JP)

(72) Inventor: Motofumi Kato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 308 days.

(21) Appl. No.: 14/352,854

(22) PCT Filed: Oct. 24, 2012

(86) PCT No.: PCT/JP2012/006799

§ 371 (c)(1),
(2) Date: Apr. 18, 2014

(87) PCT Pub. No.: WO2013/061581

PCT Pub. Date: May 2, 2013

(65) Prior Publication Data

US 2014/0306795 A1 Oct. 16, 2014

(30) Foreign Application Priority Data

Oct. 26, 2011 (JP) ..... 2011-234686

(51) Int. Cl.
*H01H 37/32* (2006.01)
*H01H 85/044* (2006.01)
*H01H 69/02* (2006.01)

(52) U.S. Cl.
CPC ..... *H01H 37/32* (2013.01); *H01H 69/02* (2013.01); *H01H 85/044* (2013.01); *Y10T 29/49107* (2015.01)

(58) Field of Classification Search
CPC ... H01H 11/00; H01H 11/003; H01H 11/0056; H01H 37/32; H01H 69/02; H01H 85/044; Y10T 29/49107
See application file for complete search history.

(56) References Cited

U.S. PATENT DOCUMENTS 4,944,084 A * 7/1990 Horibe ..... H01H 85/06 29/623
5,821,847 A * 10/1998 Totsuka ..... H01H 85/11 29/623

(Continued)

FOREIGN PATENT DOCUMENTS

| | | | |
|---|---|---|---|
| CN | 101937816 | A | 1/2011 |
| JP | 2010062085 | A | 3/2010 |
| JP | 2011-009159 | A | 1/2011 |

OTHER PUBLICATIONS

The Japanese office action letter issued on Jun. 23, 2015 in the counterpart Japanese patent application.

(Continued)

*Primary Examiner* — Carl Arbes
(74) *Attorney, Agent, or Firm* — Mots Law, PLLC

(57) ABSTRACT

A bus bar forming die (1) includes an upstream-side die block (25) configured to shape an upstream-side fuse-element portion (9) of a bus bar (23), a downstream-side die block (27) configured to shape a downstream-side fuse-element portion (15) of the bus bar (23), and a fixation portion die block (29) configured to shape fixation portions (21) of the bus bar (23). The upstream-side die block (25), the downstream-side die block (27), and the fixation portion die block (29) are configured to shape the bus bar (23) while placed in respective predetermined positions. Each of the upstream-side die block (25), the downstream-side die block (27), and the fixation portion die block (29) is replaceable in accordance with an intended shape of the bus bar (23).

1 Claim, 3 Drawing Sheets

(56) References Cited

U.S. PATENT DOCUMENTS

| | | | | |
|---|---|---|---|---|
| 2001/0011939 | A1 | 8/2001 | Inaba et al. | |
| 2004/0089129 | A1 | 5/2004 | Toth | |
| 2004/0130430 | A1 | 7/2004 | Matsumura et al. | |
| 2008/0048820 | A1 * | 2/2008 | Matsumura ..... | H01H 85/10<br>337/295 |
| 2008/0224814 | A1 | 9/2008 | Pavlovic et al. | |
| 2010/0060407 | A1 | 3/2010 | Iwata et al. | |
| 2010/0328018 | A1 | 12/2010 | Matsumoto | |
| 2012/0073125 | A1 | 3/2012 | Iwata et al. | |

OTHER PUBLICATIONS

The Korean office action letter issued on Apr. 13, 2015 in the counterpart Korean patent application.
The Chinese office action letter issued on Jul. 3, 2015 in the counterpart Chinese patent application.

* cited by examiner (a)

(b)

(a)

(b)

METHOD OF MANUFACTURING BUS BAR

TECHNICAL FIELD

The present invention relates to a bus bar forming die and a method of manufacturing a bus bar using the same.

BACKGROUND ART

PTL1 has proposed a bus bar including: an upstream-side fuse-element portion provided with paired connecting plate portions as paired conductive members, and an upstream fuse-element connecting the paired connecting plate portions together; a downstream-side fuse-element portion provided with multiple downstream fuse-elements connecting the paired connecting plate portions to multiple terminal portions; and fixation portions provided integrally with the paired connecting plate portions, and provided with connecting holes, respectively.

This bus bar is a composite fusible link formed by: obtaining a series-linked conductor in which the paired conductive members and the terminal portions are linked together in series by cutting out from a metal plate; separating this series-linked conductor into the paired conductive members and the terminal portions; thereafter performing insert molding on the paired conductive members and the terminal portions, which are separated from each other, by covering them with resin; and placing the fuse-elements in their respective positions.

CITATION LIST

Patent Literature

[PTL1] Japanese Unexamined Patent Application Publication No. 2010-62085

SUMMARY OF THE INVENTION

It is desirable that the bus bar of the type disclosed in PTL1 should be applicable to many vehicle types as a common part. If the bus bar is a common part applicable to many vehicle types, one type of die will suffice to shape the bus bar.

For example, however, in a case where the bus bar needs to have a high rated capacity, or in a case where the bus bar is placed on the top of a battery, the same bus bar cannot be applied to many vehicle types because the electric current value and the space requirement are different from one vehicle type to another. For this reason, one type of bus bar is applied to one vehicle type. In addition, even the same vehicle type includes left-hand drive vehicles and right-hand drive vehicles. In this case, too, bus bars of different types are applied.

As a result, even if the difference in structure among bus bars of multiple types is slight, as many dies need to be used. This increases costs of forming the bus bar forming dies.

An object of the present invention is to provide a bus bar forming die which makes it possible to reduce costs of shaping a bus bar and a method of manufacturing a bus bar using the same.

A bus bar forming die in accordance with some embodiments includes an upstream-side die block configured to shape an upstream-side fuse-element portion including paired conductive members of a bus bar and an upstream fuse-element connecting the paired conductive members together, a downstream-side die block configured to shape a downstream-side fuse-element portion including a plurality of downstream fuse-elements connecting the paired conductive members of the bus bar to a plurality of terminal portions, and a fixation portion die block configured to shape fixation portions provided integrally with the paired conductive members of the bus bar and including connecting holes. The upstream-side die block, the downstream-side die block, and the fixation portion die block are configured to shape the bus bar while placed in respective predetermined positions. Each of the upstream-side die block, the downstream-side die block, and the fixation portion die block is replaceable in accordance with an intended shape of the bus bar.

The foregoing configuration makes it possible to replace the upstream-side die block, the downstream-side die block, and the fixation portion die block in accordance with the intended shape of the bus bar. For this reason, an intended bus bar can be shaped by replacing only a die block corresponding to parts needed to be modified in the bus bar, and die blocks corresponding to parts remaining unmodified are no longer produced uselessly.

Accordingly, the bus bar forming die of this kind is capable of dealing with the bus bar, which has a wide variety of shapes, by replacing only the die block corresponding to parts needed to be modified. This makes it possible to reduce costs of shaping the bus bar.

The upstream-side die block may include first and second upstream-side die blocks being replaceable with each other and enable a position of the upstream fuse-element to be changed in the upstream-side fuse-element portion.

The foregoing configuration enables the position of the upstream fuse-element to be changed in the upstream-side fuse-element portion by replacing the upstream-side die block. For this reason, the bus bar applicable to a right-hand drive vehicle and the bus bar applicable to a left-hand drive vehicle of the same vehicle type can be shaped by replacing only the upstream-side die block.

A method of manufacturing a bus bar using a bus bar forming die in accordance with some embodiments includes the following. The bus bar forming die includes an upstream-side die block configured to shape an upstream-side fuse-element portion including paired conductive members of a bus bar and an upstream fuse-element connecting the paired conductive members together, a downstream-side die block configured to shape a downstream-side fuse-element portion including a plurality of downstream fuse-elements connecting the paired conductive members of the bus bar to a plurality of terminal portions, and a fixation portion die block configured to shape fixation portions provided integrally with the paired conductive members of the bus bar and including connecting holes. The method includes selecting the upstream-side die block, the downstream-side die block, and the fixation portion die block in accordance with an intended shape of the bus bar, placing the upstream-side die block, the downstream-side die block, and the fixation portion die block as selected in respective predetermined positions, and placing material of the bus bar toward the upstream-side die block, the downstream-side die block, and the fixation portion die block as placed to shape the bus bar.

The foregoing configuration allows the upstream-side die block, the downstream-side die block, and the fixation portion die block to be selected in accordance with the intended shape of the bus bar. For this reason, the bus bar which has a wide variety of shapes can be shaped by selecting the die blocks, and costs of shaping the bus bar can be reduced.

The foregoing configuration can provide the bus bar forming die which makes it possible to reduce the costs of shaping the bus bar and the method of manufacturing the bus bar using the same.

DESCRIPTION OF EMBODIMENTS

Figure 1:
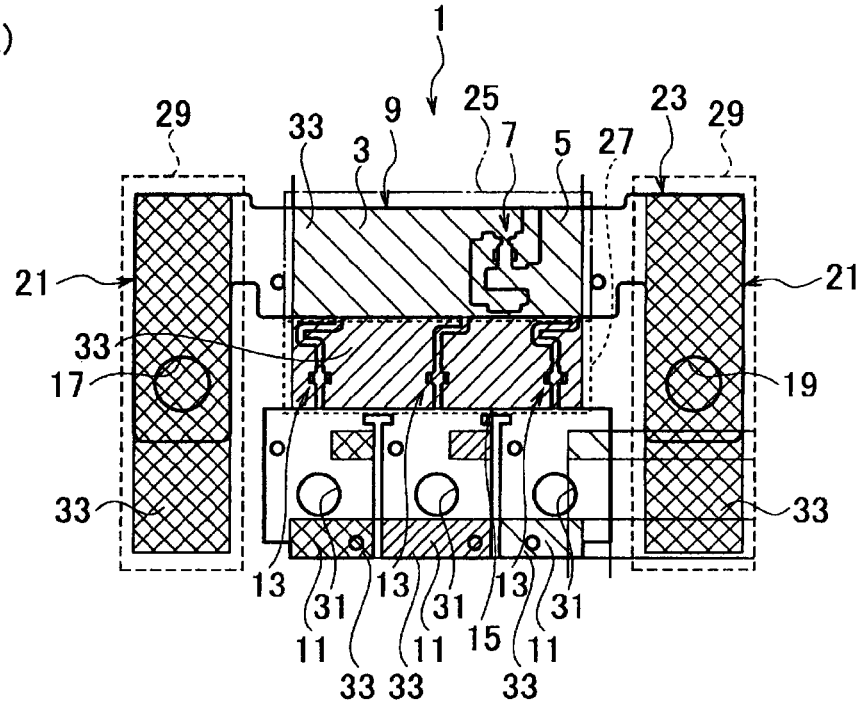
FIG. 1(*a*) is a top view of a bus bar forming die and a bus bar of an embodiment of the present invention, and FIG. 1(*b*) is a schematic diagram of the bus bar forming die of the embodiment of the present invention.
Figure 1:
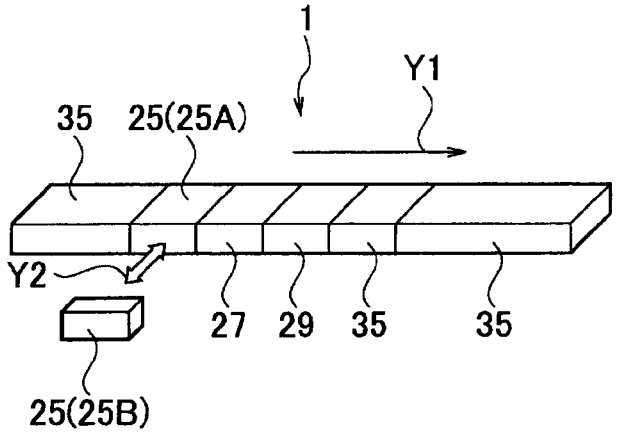
Figure 2:
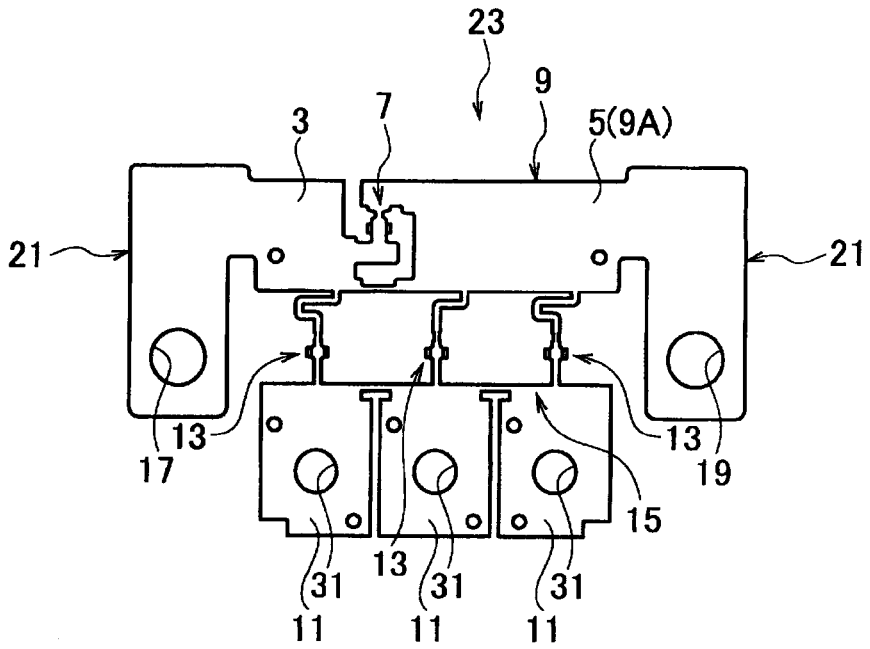
FIG. 2(*a*) is a top view of a bus bar shaped by use of an upstream-side die block as an example of the bus bar forming die of the embodiment of the present invention, and FIG. 2(*b*) is a top view of a bus bar shaped by use of an upstream-side die block as another example of the bus bar forming die of the embodiment of the present invention.
Figure 2:
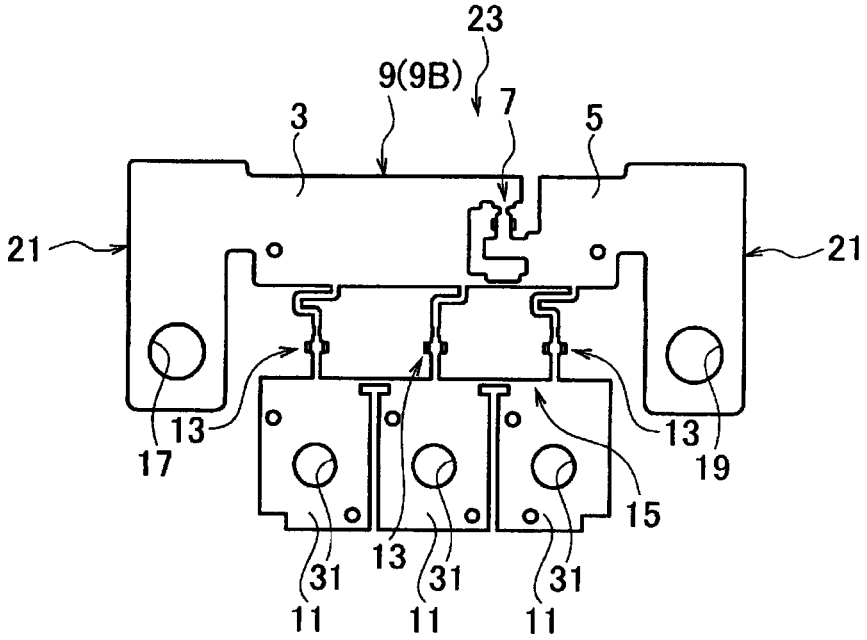
Figure 3:
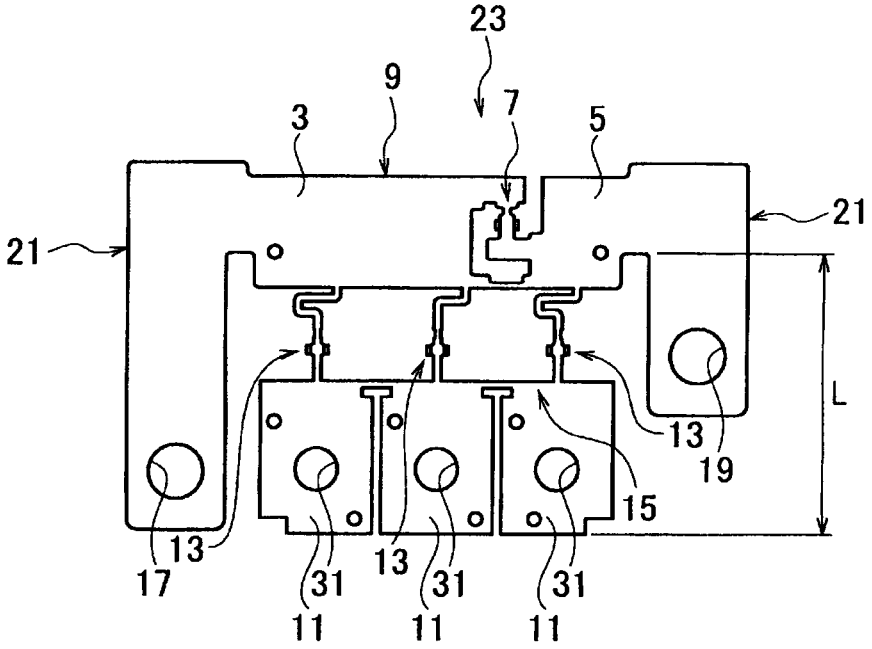
FIG. 3 is a top view of a bus bar shaped by use of a fixation portion die block as an example of the bus bar forming die of the embodiment of the present invention.

Descriptions will be provided for a bus bar forming die of the present invention and a method of manufacturing a bus bar using the bus bar forming die by use of FIGS. 1 to 3.

A bus bar forming die 1 of the embodiment shapes a bus bar 23 which includes: an upstream-side fuse-element portion 9; a downstream-side fuse-element portion 15; and fixation portions 21, 21. The upstream-side fuse-element portion 9 is provided with: paired conductive members 3, 5; and an upstream fuse-element 7 connecting the paired conductive members 3, 5 together. The downstream-side fuse-element portion 15 is provided with multiple downstream fuse-elements 13 connecting the paired conductive members 3, 5 to multiple terminal portions 11. The fixation portions 21, 21 are provided integrally with the paired conductive members 3, 5, and are provided with connecting hole portions 17, 19, respectively.

The bus bar forming die 1 includes: an upstream-side die block 25 configured to shape the upstream-side fuse-element portion 9; a downstream-side die block 27 configured to shape the downstream-side fuse-element portion 15; and a fixation portion die block 29 configured to shape the respective fixation portions 21, 21.

The upstream-side die block 25, the downstream-side die block 27, and the fixation portion die block 29 shape the bus bar 23 while placed in the respective predetermined positions.

Each of the upstream-side die block 25, the downstream-side die block 27, and the fixation portion die block 29 is replaceable in accordance with the intended shape of the bus bar 23

The upstream-side die block 25 enables the position of the upstream fuse-element 7 to be changed in the upstream-side fuse-element portion 9. For example, as shown in FIG. 1(*b*), the upstream-side die block 25 includes a first upstream-side die block 25A and a second upstream-side die block 25B which are replaceable with each other and enable the position of the upstream fuse-element 7 to be changed in the upstream-side fuse-element portion 9.

A method of manufacturing a bus bar for the bus bar forming die 1 of this kind includes: a first step of selecting the upstream-side die block 25, the downstream-side die block 27, and the fixation portion die block 29 in accordance with the intended shape of the bus bar 23; a second step of placing the upstream-side die block 25, the downstream-side die block 27, and the fixation portion die block 29, which are selected in the first step, in their respective predetermined positions; and a third step of shaping the bus bar 23 by placing material of the bus bar 23 toward the upstream-side die block 25, the downstream-side die block 27, and the fixation portion die block 29 which are placed in the second step.

As shown in FIGS. 1 to 3, the bus bar 23 is formed from conductive material, and includes the upstream-side fuse-element portion 9, the multiple terminal portions 11, the downstream-side fuse-element portion 15, and the fixation portions 21. The upstream-side fuse-element portion 9 includes the paired conductive members 3, 5 and the upstream fuse-element 7.

The paired conductive members 3, 5 are connected to a power source like a battery which is mounted on a vehicle. The paired conductive members 3, 5 supply the multiple terminal portions 11 with electric power from the power source. The upstream fuse-element 7 is provided between the paired conductive members 3, 5.

The upstream fuse-element 7 is a large-capacity fuse which connects the paired conductive members 3, 5 together, and which is configured to fuse when a relatively large excessive current flows through the paired conductive members 3, 5. The paired conductive members 3, 5, which are connected together by the upstream fuse-element 7, supply the electric power to the multiple terminal portions 11.

Connector portions 31 formed from hole portions are formed in the multiple terminal portions 11, respectively. Conductive members (not illustrated) such as wire harnesses, which are connected to electronic parts and the like mounted on the vehicle, are connected to the hole portions. The multiple terminal portions 11 supply the electronic parts and the like with the electric power from the power source. The downstream-side fuse-element portion 15 is provided between the multiple terminal portions 11 and the paired conductive members 3, 5.

The downstream-side fuse-element portion 15 includes the multiple downstream fuse-elements 13. The multiple downstream fuse-elements 13 connect the paired conductive members 3, 5 and the multiple terminal portions 11 together. The multiple downstream fuse-elements 13 are fuses configured to fuse when an excessive current flows between the power source and the electronic parts. The fixation portions 21 are provided to the paired conductive members 3, 5 which are connected to the multiple terminal portions 11 via the multiple downstream fuse-elements 13.

The fixation portions 21 are provided to the paired conductive members 3, 5, and includes the hole portions 17, 19 provided to the paired conductive members 3, 5, respectively. The hole portions 17, 19 are provided in portions of the paired conductive members 3, 5 which extend outward from the upstream-side fuse-element portion 9, respectively. Fixation members (not illustrated), such as bolts, are inserted into the hole portions 17, 19. The fixation members are fixed to the power source, and the power source is electrically connected to the paired conductive members 3, 5.

After shaped by the bus bar forming die 1, the thus configured bus bar 23 is turned into a fusible link unit through mold-forming using resin 33. Once this fusible link unit is placed in a power source box or the like, the power source is connected to the electronic parts via the bus bar 23 having a fuse function. The bus bar 23 of this kind is shaped using the bus bar forming die 1.

The bus bar forming die 1 includes the upstream-side die block 25, the downstream-side die block 27, and the fixation portion die block 29. The upstream-side die block 25 shapes the upstream-side fuse-element portion 9 of the bus bar 23. The upstream-side die block 25 sets the upstream fuse-element 7 in a way that makes the upstream fuse-element 7 fuse at a rated current value of a vehicle type on which the upstream fuse element 7 is mounted. The upstream-side die block 25 is capable of dealing with many vehicle types by changing the setting of the upstream fuse-element 7. As shown in FIGS. 2(*a*) and 2(*b*), the upstream-side die block 25 is capable of changing the position of the upstream fuse-element 7 between the paired conductive members 3, 5 in the upstream-side fuse-element portion 9 (a first upstream-side fuse-element portion 9A and a second upstream-side fuse-element portion 9B). The upstream-side die block 25 is capable of dealing with a circuit for a right-hand drive vehicle and a circuit for a left-hand drive vehicle of the same vehicle type by changing the position of the upstream fuse-element 7.

The downstream-side die block 27 shapes the downstream-side fuse-element portion 15 of the bus bar 23. The downstream-side die block 27 sets the multiple downstream fuse-elements 13 in a way that makes the multiple downstream fuse-elements 13 fuse at the respective rated current values of the electronic parts of a vehicle type on which the multiple downstream fuse-elements 13 are mounted. The downstream-side die block 27 is capable of dealing with many vehicle types by changing the settings of the multiple downstream fuse-elements 13.

The fixation portion die block 29 shapes the fixation portions 21 of the bus bar 23. As shown in FIG. 3, the fixation portion die block 29 sets the lengths L of the fixation portions 21 provided to the paired conductive members 3, 5, and the positions of the hole portions 17, 19 in the fixation portions 21 provided to the paired conductive members 3, 5 in accordance with the power supply of a vehicle type on which the fixation portions 21 are mounted. The fixation portion die block 29 is capable of dealing with various modes of the attachment to a power source by changing: the setting of the lengths L of the fixation portions 21 provided to the paired conductive members 3, 5; and the setting of the positions of the hole portions 17, 19 in the fixation portions 21 provided to the paired conductive members 3, 5. The shaping of the fixation portions 21 by use of the fixation portion die block 29 may be carried out by only setting the lengths L of the fixation portions 21 provided to the paired conductive members 3, 5, or by only setting the positions of the hole portions 17, 19 in the fixation portions 21 provided to the paired conductive members 3, 5.

As indicated by an arrow Y1 in FIG. 1(*b*), the upstream-side die block 25, the downstream-side die block 27, and the fixation portion die block 29 of this kind are placed in series in a conveyance direction of the material of the bus bar 23, and shape the conveyed material of the bus bar 23, as well as thereby produce the bus bar 23 in an intended shape. Multiple common-use die blocks 35 configured to apply processes to the material of the bus bar 23 and the bus bar 23 in the intended shape are placed upstream and downstream of the upstream-side die block 25, the downstream-side die block 27, and the fixation portion die block 29 in the conveyance direction.

The upstream-side die block 25, the downstream-side die block 27, and the fixation portion die block 29, which are placed as described above, are replaceable in the same manner as a cassette is replaceable. Only with regard to modified parts, a current die block is replaced with another die block in accordance with a vehicle type on which the bus bar 23 is mounted. Thereby, the bus bar 23 is shaped into the intended shape. FIG. 1(*b*) shows a case where the upstream-side die blocks 25 (25A, 25B) are replaced with each other as indicated by an arrow Y2. Similarly, other die blocks can be replaced.

Since, as described above, the upstream-side die block 25, the downstream-side die block 27, and the fixation portion die block 29 are designed to be replaceable, the bus bar forming die 1 can be applied to many vehicle types by replacing only a die block which corresponds to parts needed to be modified in the bus bar 23 suffices. In addition, since the die production is limited to the parts needed to be modified in the bus bar 23, a die block corresponding to parts remaining unmodified need not be produced, and costs of the die, which would otherwise need to be produced, can be reduced. Furthermore, since a larger die need not be produced uselessly, it is possible to reduce the die storage space, and costs of die maintenance and management.

Descriptions will be provided for a method of manufacturing the bus bar 23 by use of the bus bar forming die 1 of this kind. First of all, the upstream-side die block 25, the downstream-side die block 27, and the fixation portion die block 29 are selected for the purpose of shaping the bus bar 23 in an intended shape which meets a vehicle type on which to mount the bus bar 23 (in a first step).

Subsequently, as shown in FIG. 1(*b*), the upstream-side die block 25, the downstream-side die block 27, and the fixation portion die block 29, which have been selected, are placed in series in a conveyance direction of the bus bar 23 (in a second step).

Thereafter, the material of the bus bar 23 is placed upstream of the upstream-side die block 25, the downstream-side die block 27, and the fixation portion die block 29 which are arranged in series, in the conveyance direction of the bus bar 23. After that, the material of the bus bar 23 is conveyed, and is sequentially shaped into an intended shape by the die blocks (in a third step).

In the bus bar forming die 1 of this kind, the upstream-side die block 25, the downstream-side die block 27, and the fixation portion die block 29 are replaceable in accordance with the intended shape of the bus bar 23. For this reason, the intended bus bar 23 can be shaped by replacing only a die block corresponding to parts needed to be modified in the bus bar 23, and die blocks corresponding to parts remaining unmodified in the bus bar 23 need not be produced uselessly.

Accordingly, the bus bar forming die 1 of this kind is capable of dealing with the bus bar 23, which has a wide variety of shapes, by replacing only a die block corresponding to parts needed to be modified in the bus bar 23. Thus, costs of shaping the bus bar 23 can be reduced.

Since the upstream-side die block 25 includes the first and second upstream-side die blocks 25A, 25B which enable the position of the upstream fuse-element 7 to be changed in the upstream-side fuse-element portion 9, the bus bar 23 for a right-hand drive vehicle and the bus bar 23 for a left-hand drive vehicle of the same vehicle type can be shaped by replacing only the upstream-side die block 25.

Since the method of manufacturing the bus bar for the bus bar forming die 1 allows the upstream-side die block 25, the downstream-side die block 27, and the fixation portion die block 29 to be selected in accordance with the intended shape of the bus bar, the bus bar 23 which has the wide variety of shapes can be shaped by selecting the die blocks. Thereby, the costs of shaping the bus bar 23 can be reduced.

It should be noted that although the bus bar forming die 1 of the embodiment of the present invention includes the upstream-side die block 25, the downstream-side die block 27, and the fixation portion die block 29, the bus bar forming die 1 is not limited to this division scheme. For example, a division scheme may be employed in which a portion of the bus bar which is expected to be modified from a vehicle type to another is divided into as many pieces as possible, and multiple die blocks capable of shaping these divided pieces are replaceable with each other.

The entire content of Japanese Patent Application No. 2011-234686, filed on Oct. 26, 2011, is herein incorporated by reference.

The invention claimed is:

1. A method of manufacturing a bus bar using a bus bar forming die, the bus bar forming die including: an upstream-side die block configured to shape an upstream-side fuse-element portion including paired conductive members of a bus bar and an upstream fuse-element connecting the paired conductive members together; a downstream-side die block configured to shape a downstream-side fuse-element portion including a plurality of downstream fuse-elements connecting the paired conductive members of the bus bar to a plurality of terminal portions; and a fixation portion die block configured to shape fixation portions provided integrally with the paired conductive members of the bus bar and including connecting holes, the method comprising:

selecting the upstream-side die block, the downstream-side die block, and the fixation portion die block in accordance with an intended shape of the bus bar;

placing the upstream-side die block, the downstream-side die block, and the fixation portion die block as selected in respective predetermined positions; and placing material of the bus bar toward the upstream-side die block, the downstream-side die block, and the fixation portion die block as placed to shape the bus bar.

* * * * *